United States Patent [19]

Broadbent

[11] Patent Number: 4,470,728

[45] Date of Patent: Sep. 11, 1984

[54] REINFORCED EARTH STRUCTURES AND FACING UNITS THEREFOR

[75] Inventor: Stephen Broadbent, Leeds, England

[73] Assignee: West Yorkshire Metropolitan County Council, Wakefield, England

[21] Appl. No.: 384,798

[22] Filed: Jun. 4, 1982

[30] Foreign Application Priority Data

Jun. 11, 1981 [GB] United Kingdom ..... 8117947

[51] Int. Cl.[3] ..... E02D 29/02

[52] U.S. Cl. ..... 405/284; 405/286

[58] Field of Search ..... 405/284, 285, 286, 287, 405/258, 262, 272

[56] References Cited

U.S. PATENT DOCUMENTS

| | | | |
|---|---|---|---|
| 2,420,228 | 5/1947 | Condon | 405/286 |
| 3,953,979 | 5/1976 | Kurose | 405/286 |
| 4,343,572 | 8/1982 | Hilfiker | 405/284 |

FOREIGN PATENT DOCUMENTS

| | | | |
|---|---|---|---|
| 747703 | 6/1933 | France . | |
| 2055983 | 5/1971 | France . | |
| 2436331 | 4/1980 | France | 405/284 |
| 1485004 | 9/1977 | United Kingdom . | |
| 2025496 | 1/1980 | United Kingdom . | |

*Primary Examiner*—David H. Corbin

*Attorney, Agent, or Firm*—Norbert P. Holler; Charles A. Blank

[57] ABSTRACT

A facing unit for a reinforced earth structure, the unit having a facing element (1) that is designed to extend substantially vertically in the finished structure. A base (2) extends rearwardly from the rear surface of the facing element and at least one anchoring element (6) of lesser width than the base extends upwardly from the base. The anchoring element has a retaining surface (12) spaced rearwardly from and facing towards the rear surface of the facing element over which may be placed a link (21) connected to an anchoring member (23) extending into compacted earth behind the units.

8 Claims, 16 Drawing Figures

REINFORCED EARTH STRUCTURES AND FACING UNITS THEREFOR

This invention relates to facing units for use with reinforced earth structures, and to structures incorporating such units.

The use of facing units with reinforced earth structures is known, and a number of different types of unit have been proposed. In each case the unit requires to be tied into the back fill material behind the unit and this is done by securing straps or other anchoring members to the units, the anchoring members extending back into the compacted earth and being retained by the engagement between the anchoring member and the earth. There have been a number of different proposals for securing anchoring members to the facing units, but these have been generally complex. Furthermore, facing units that have been proposed have been heavy and generally not capable of being handled by two men. They have also been prone to damage by differential settlement between the back fill and the facing units. The object of the present invention is to provide a novel facing unit that allows certain of these disadvantages to be mitigated.

According to the present invention a facing unit for a reinforced earth structure comprises a facing element having a front surface and a rear surface and designed to extend substantially vertically in the finished structure, a base extending rearwardly from the rear surface of the facing element at a lower part thereof across substantially the full width of the facing element at that part, and at least one anchoring element of lesser width than the base extending upwardly from the base and having a retaining surface spaced rearwardly from and facing towards the rear surface of the facing element.

The invention further extends to a reinforced earth structure comprising a plurality of facing units as aforesaid, arranged so that their facing elements combine to form a wall, and anchoring members secured to anchoring elements of selected units and extending rearwardly therefrom into compacted earth behind the units.

In one embodiment of the invention the anchoring element has a lower section joined to the rear surface of the facing element and an upper section spaced from said rear surface and presenting the retaining surface facing towards and parallel to the rear surface.

The facing unit of this embodiment can easily be secured into a reinforced earth structure merely by looping the anchoring member, or a link for the anchoring member, around the anchoring element. Apart from affording a very rapid and simple connection it also allows relative movement between the facing unit and the anchoring member, so allowing settling of the back fill without adverse effects on the facing units.

In a second embodiment the anchoring element is joined to the rear surface of the facing element over substantially the entire height thereof and the upper end of the anchoring element is formed with a downwardly extending recess having a face constituting the retaining face.

In this construction the anchoring member may be secured to a facing unit merely by locating part of the anchoring member, or a link for the anchoring member, in the downwardly extending recess. The recess may cooperate with an upwardly extending recess formed in the lower surface of the base of the unit immediately above, the two recesses forming an anchor-receiving formation in which an element secured to the anchoring member may be received.

The uppermost part of the or each anchoring element is preferably substantially level with the uppermost part of the facing element. This facilitates handling and stacking of the units. The uppermost part of the or each anchoring element may further be formed with interlock means that can engage cooperating interlock means on the lower surface of a further facing unit.

Facing units according to the invention may readily be formed as integral structures, and it is particularly convenient if they are concrete castings. Their size can then be made such that the units are readily capable of being handled by two men, thus considerably simplifying erection of the structure. The facing element may be of any required shape, desirably a shape that will facilitate stacking and interlocking of units. For example, rectangular or hexagonal facing elements may be preferred.

To assist in a fuller understanding of the invention specific embodiments of facing units and reinforced structures in accordance therewith will now be described in more detail, by way of example only, with reference to the accompanying drawings in which.

Figure 13:
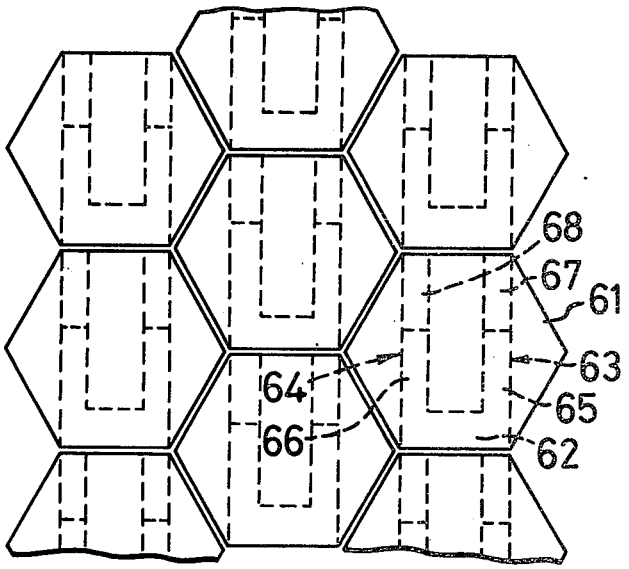
Figure 14:
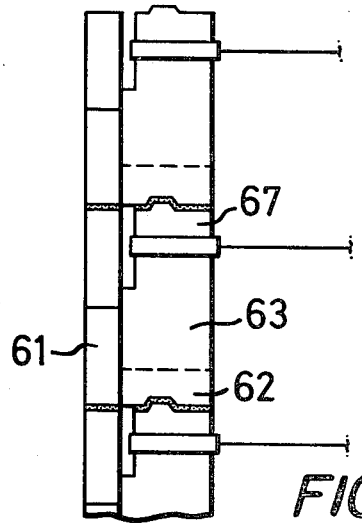
Figure 15:
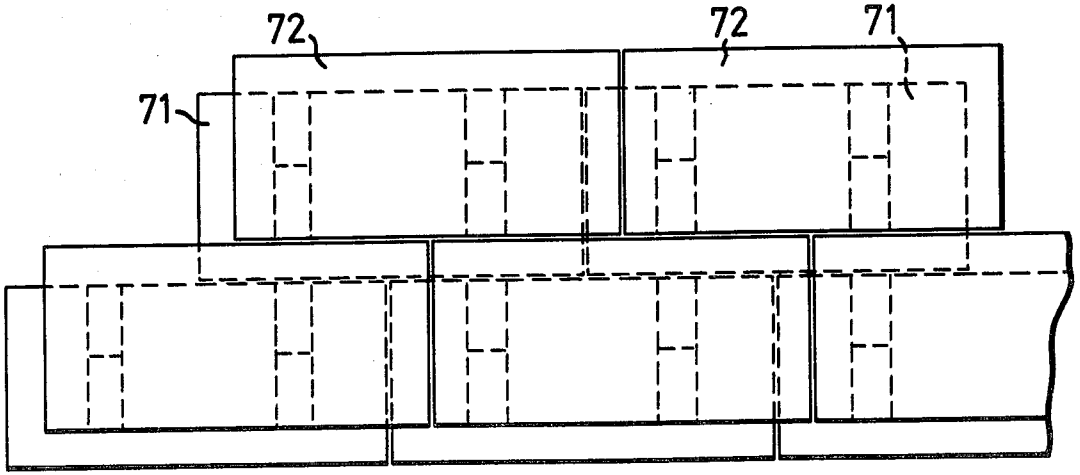
Figure 16:
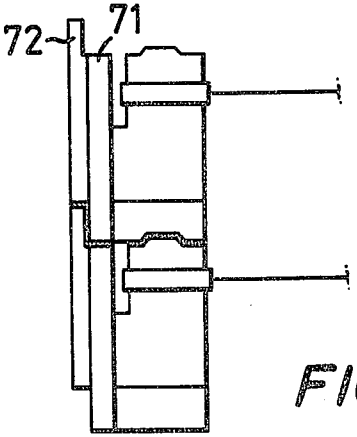

FIGS. 13 and 14 are respectively front and end elevations of a structure comprising a further embodiment of unit; and FIGS. 15 and 16 are similar to FIGS. 13 and 14 and show yet another embodiment of unit.

Figure 1:
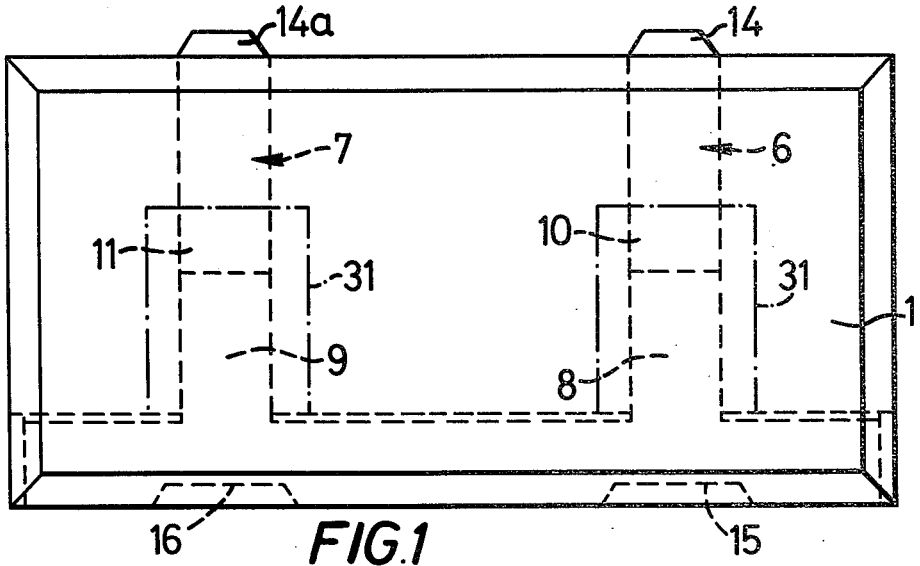
FIGS. 1, 2 and 3, are, respectively, a front elevation, plan view and end elevation of a first embodiment of unit.
Figure 2:
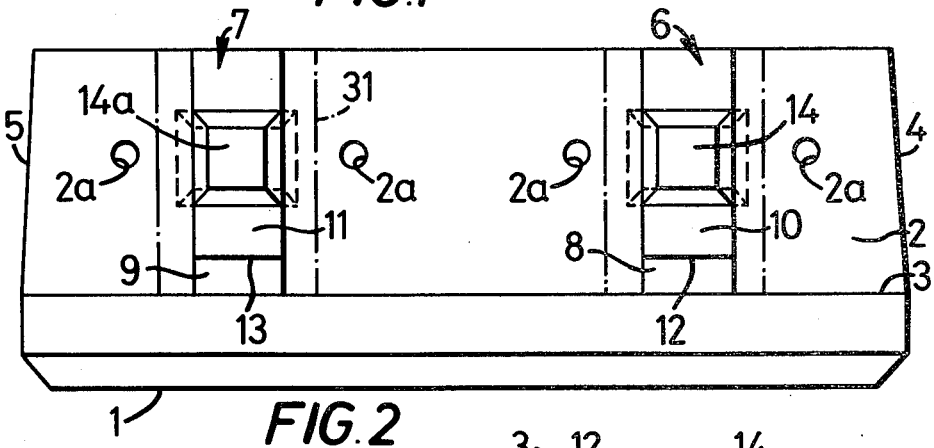
Figure 3:
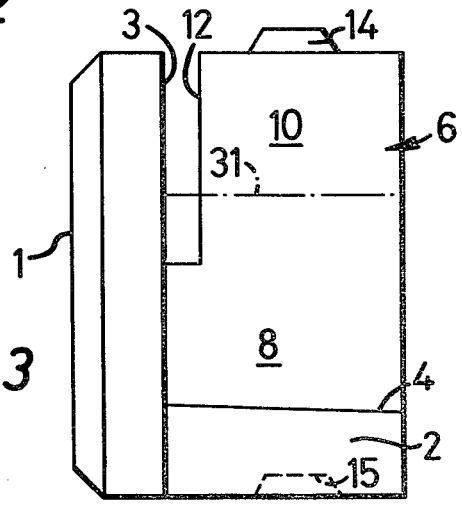

Referring now to FIGS. 1 to 3 there is shown a facing unit having a front or facing element 1 that is designed to extend vertically in the finished structure. A base 2 extends rearwardly from a rear surface 3 of the facing element at the lower part thereof across substantially the full width of the facing element. The edges 4, 5 of the base are inwardly tapered from front to rear of the unit as will be seen from FIG. 2, and the upper surface 5 of the base slopes downwardly from front to rear as seen in FIG. 3. Holes 2*a*, for drainage or additional anchorage, may if desired be provided in the base. Two anchoring elements 6 and 7 extend upwardly from the base. The anchoring elements are aligned symmetrically with respect to the width of the unit and the distance between the centreline of an anchoring element and the adjacent edge of the unit is approximately one quarter the total width of the unit. Each anchoring element has a lower section 8, 9 respectively joined to the rear surface of the facing element and an upper section 10, 11 respectively spaced from said rear surface. Each upper section is rectangular in plan view and has a front face 12, 13 respectively that faces towards and is parallel to the rear surface 3 of the facing element and that constitutes a retaining surface. The uppermost part of each anchoring element is substantially level with the uppermost part of the facing element, and is formed with a projection 14, 14*a* respectively, the projections having tapered sides and being of interlocking formation with recesses 15, 16 respectively in the lower surface of the base.

The facing unit shown can readily be cast from concrete, although it will be understood that it could be made in any one of a multiplicity of different materials.

Figure 4:
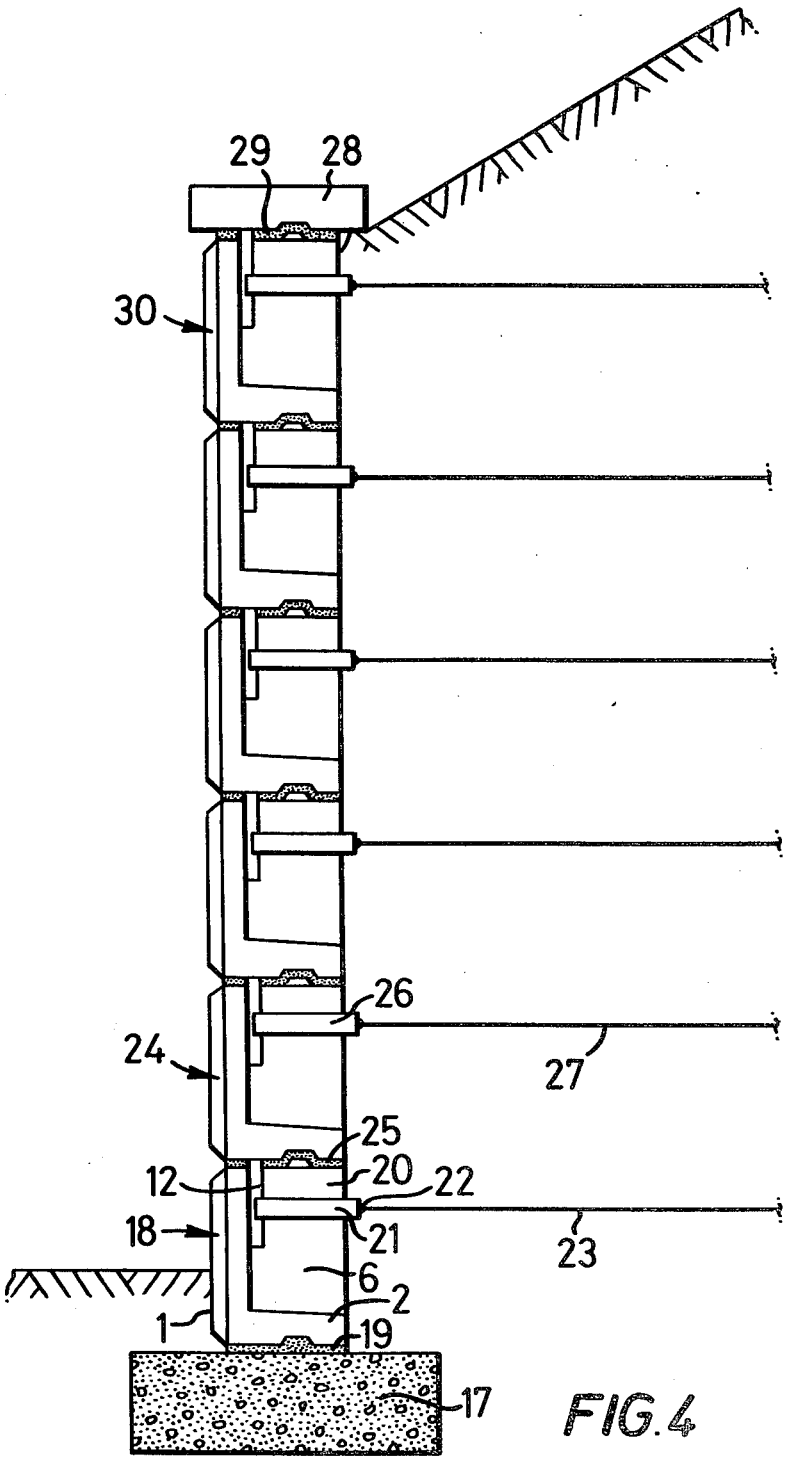
FIG. 4 shows a reinforced earth structure incorporating the facing units of FIGS. 1 to 3.

FIG. 4 shows a plurality of the units of FIGS. 1 to 3 arranged to form a retaining wall facing a reinforced earth structure. In building this structure a foundation 17 is first made and the lowermost facing unit 18 is secured to the foundation by mortar 19. Over each of the anchoring elements such as 20 of the unit 18 there is placed a loop 21 of stainless or galvanised steel to which is welded at 22 a stainless or galvanised steel anchoring strap 23 that rearwardly from the unit over a base layer of earth having its surface substantially at the level of the straps 23.

A second unit 24 is then placed on top of the first unit 18 and secured thereto, for example by mortar 25, the projections 14, 14*a* from the unit 18 engaging in the recesses 15, 16 in the lower surface of the base of the unit 24. The two units are thus positively located with respect one to the other. Back fill material is then placed on top of the anchoring straps 23 and underlying material and is compacted to an appropriate level. When this has been done a stainless steel loop 26 is placed over each of the anchoring elements of the unit 24, each loop 26 again having welded thereto a stainless steel anchoring strap 27 which overlies the compacted earth.

The same procedure is followed to lay the other units and build up the reinforced earth structure behind those units. When the required height is reached a coping element 28 can be secured by mortar 29 to the uppermost unit 30. It will be appreciated that only a single column of units is shown in FIG. 4 and that in practice a wall of the required length and height will be built, units in one course overlying (and interlocking if required) with two adjacent units in the course beneath. Although mortar has been suggested between courses, other material, such as flexible polyurethane foam, could be used.

The very great simplicity with which the anchoring straps such as 23 and 27 are connected to the facing units will particularly be appreciated. It will also be appreciated that the loops are movable vertically relative to the anchoring elements and the anchoring straps can thus settle with the back fill material without applying undue loads to the facing units. This is facilitated if the lower part of each anchoring element is surrounded by a resiliently compressible material as indicated by the chain dotted lines 31 in FIGS. 1 to 3. The material is conveniently adhesively bonded to the anchoring elements and a particularly suitable material is expanded polystyrene. The effect of this material is to provide a resilient backing for the loop and ensure that downward movement thereof relative to the facing unit is allowed. If the resilient material were not present then there would be a possibility of back fill material becoming compacted below the loop and thus providing a rigid non-compressible backing for the loop with the result that settling forces in the back fill would be transmitted to the facing unit.

Figure 5:
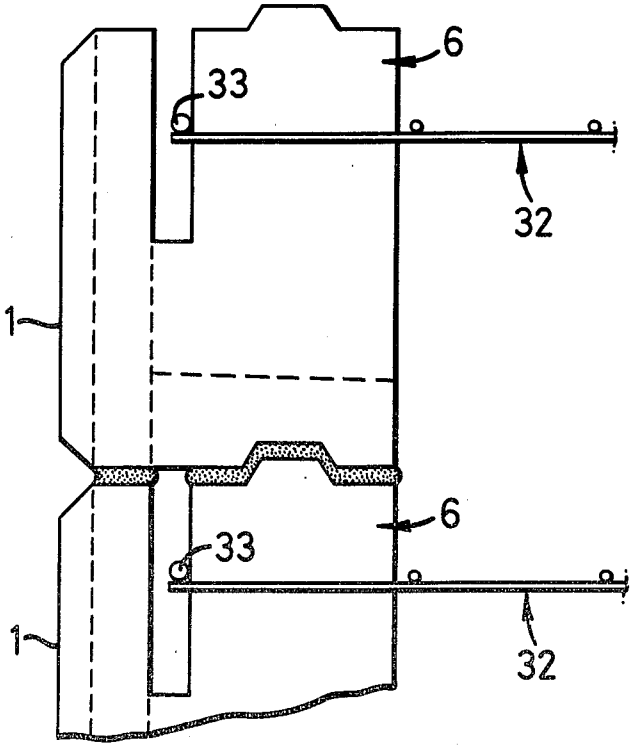

FIG. 5 shows a construction wherein the earth anchoring members are not in the form of straps, but rather in the form of a welded mesh material 32, the end bar 33 of which is of greater diameter than the remaining elements of the mesh. The mesh is very simply connected to the facing units by dropping the mesh over the anchoring elements of the units so that the end bar of the mesh is held captive by the retaining surfaces of the anchoring elements. The pitch of the mesh is obviously designed to suit the spacing between anchoring elements so that a single mesh may engage the anchoring elements of a plurality of facing units in a single course.

Figure 6:
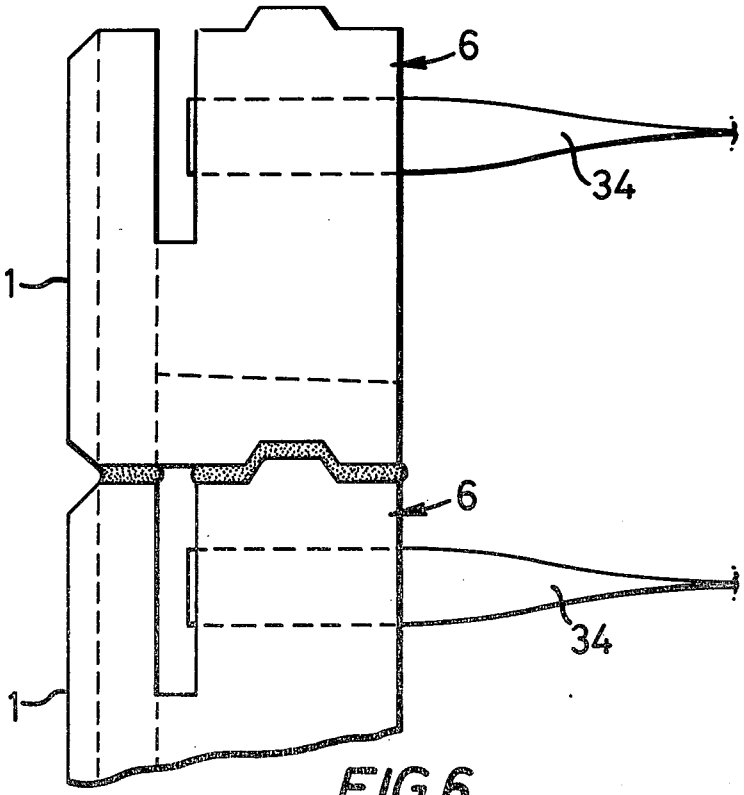
FIGS. 5 and 6 illustrate alternative methods of incorporating the units of FIGS. 1 to 3 into a reinforced earth structure.

FIG. 6 shows a further alternative for anchoring stainless or galvanised steel or plastics material anchoring straps extending into the compacted earth. Where present in the earth the straps 34 lie with their surfaces substantially horizontal, but in the region of the facing units the straps are twisted as shown in FIG. 6 so that their surfaces pass around the anchoring elements of the facing units. In either of the FIG. 5 and 6 embodiments resilient, compressible material may be incorporated in the facing unit as previously described.

Figure 8:
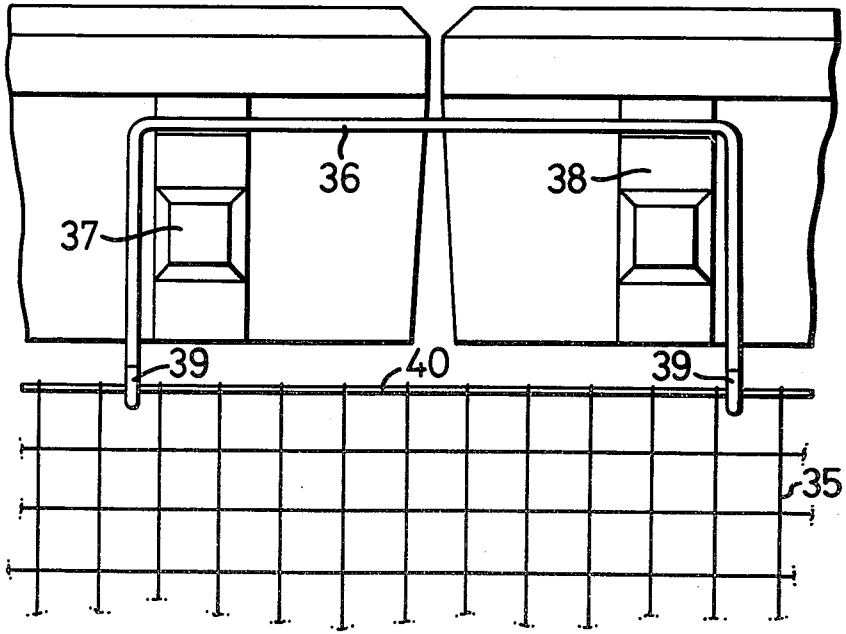
FIGS. 7 and 8 show a further alternative method of incorporating the units of FIGS. 1 to 3 into a reinforced earth structure.
Figure 7:
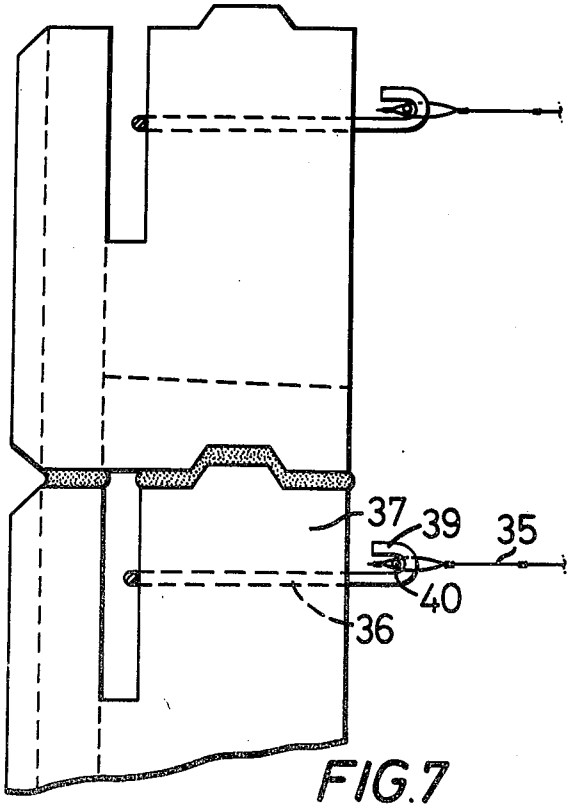

FIGS. 7 and 8 show another method whereby the facing units of FIGS. 1 to 3 can be anchored to a welded mesh anchoring member 35. A substantially U-shaped link 36 is placed over the anchoring elements 37, 38 of two adjacent facing units. The link has arms terminating in hooks 39 which engage a bar 40, interwoven through the mesh 35 in any convenient manner.

Figure 9:
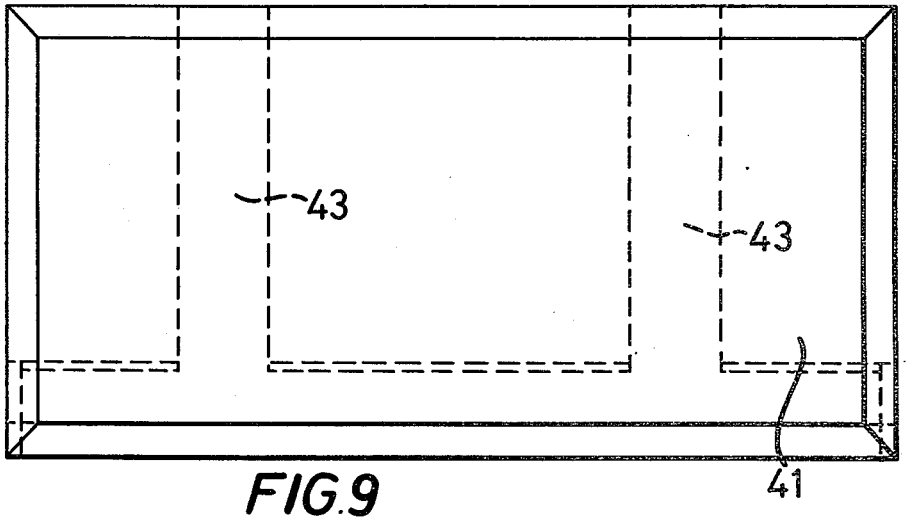
FIGS. 9, 10 and 11 are respectively a front element, plan view and side elevation of an alternative embodiment of unit.
Figure 10:
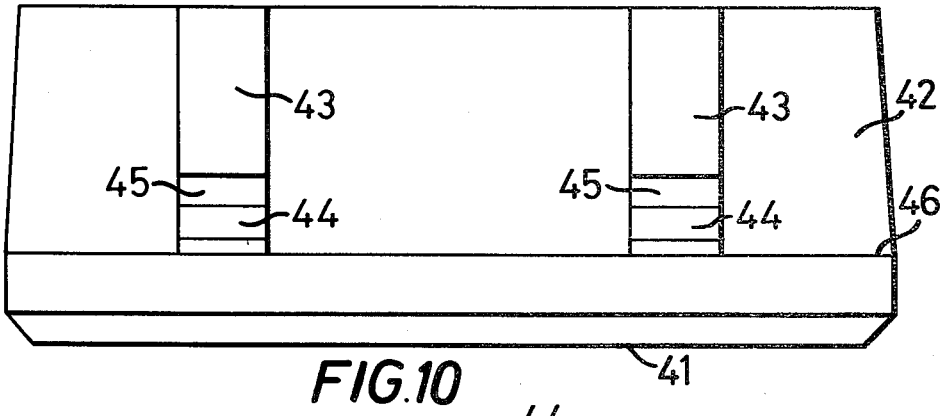
Figure 11:
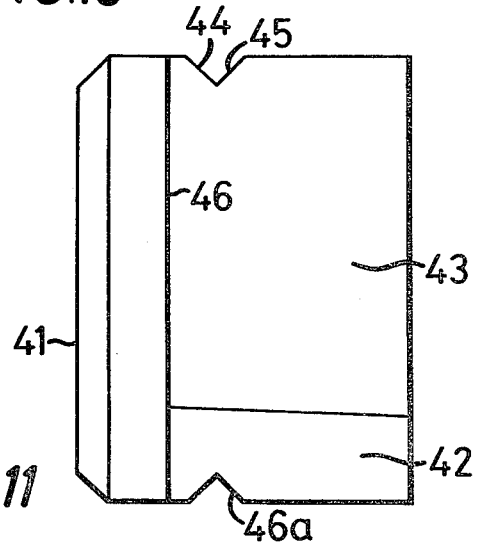
Figure 12:
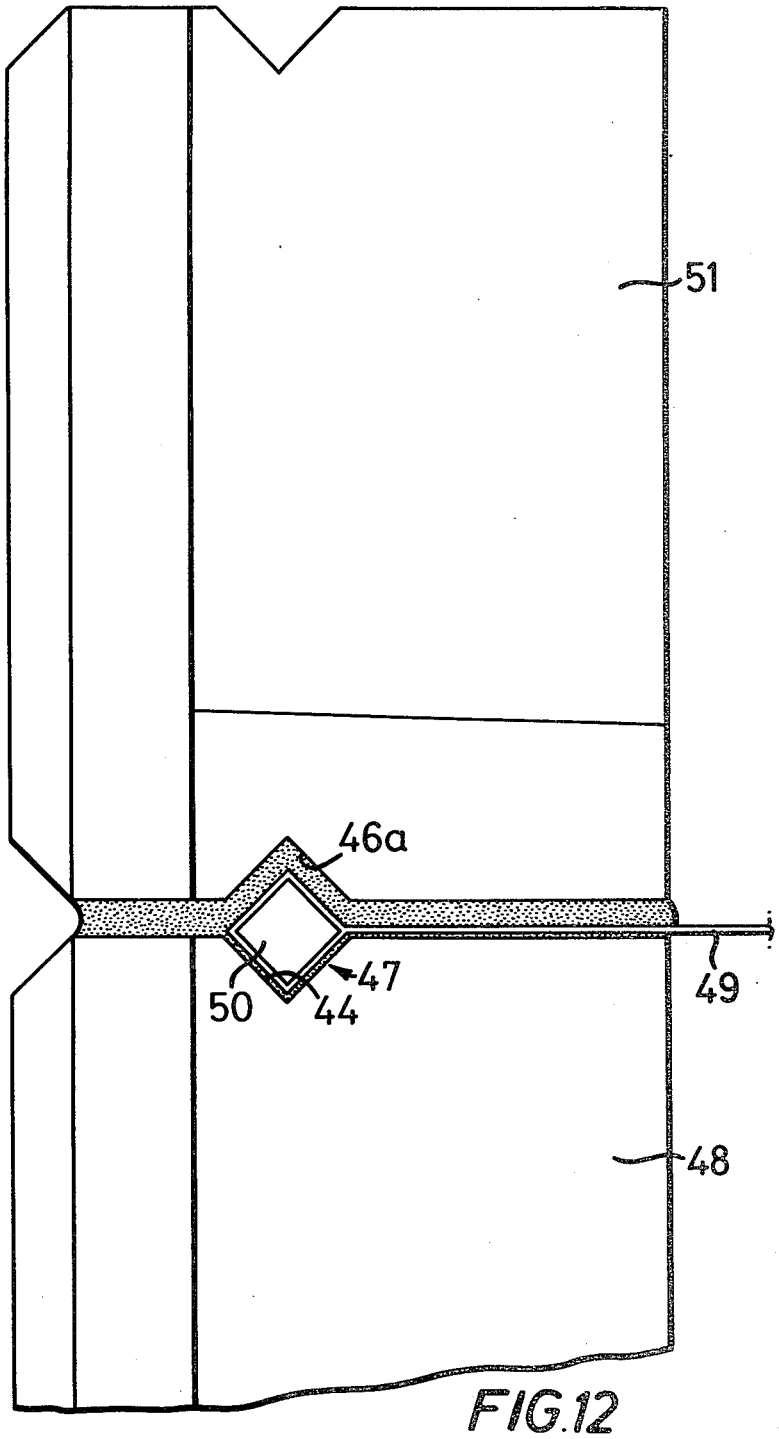
FIG. 12 illustrates one method of incorporating the unit of FIGS. 9 to 11 into a reinforced earth structure.

The facing unit shown in FIGS. 9 to 11 is similar to that shown in FIGS. 1 to 3 in that it has a facing element 41, a base 42 extending rearwardly from the rear surface of the facing element at the lower part thereof across substantially the full width of the facing element and two anchoring elements 43 extending upwardly from the base. In this embodiment, however, each anchoring element is joined to the rear surface of the facing element over substantially the entire height thereof. The upper end of each anchoring element is formed with a downwardly extending recess 44, having a face 45 facing towards the rear face 46 of the facing element 41 and constituting a retaining face. The lower surface of the base 42 is formed with an upwardly extending recess 46*a* which, as will be seen from FIG. 12, cooperates with the downwardly extending recess 44 of a lower unit to form an anchor receiving formation 47.

Using units as shown in these Figures to form a retaining wall for a reinforced earth structure a lowermost unit 48 is first laid on a foundation and back fill is compacted to the level of the top of the unit. Earth anchoring members in the form of sheet metal straps or straps or sheeting of plastics or other non-biodegradable material 49 are wrapped around a square section anchor bar 50 which extends between the two anchoring elements of the unit and is received in the downwardly extending recesses of each anchoring element. Mortar is then placed over the tops of the anchoring elements and on the upper edge of the facing elements and an upper facing unit 51 is laid on the mortar, the recess 46*a* in the lower surface thereof cooperating with the recesses 44 to hold the anchor bar firmly in position. Back fill is then placed over the earth anchoring members and the process is repeated until the desired wall and reinforced earth structure has been completed.

It will be appreciated that the recesses in the upper end of the anchoring element and in the lower surface of the base may have a cross-section other than that shown in the drawings. It will also be understood that the anchor bar may have a cross-section other than that shown, and it is not necessary that the cross-section of the anchor bar be identical with the cross-section formed by the cooperating recesses. For example, the anchor bar shown in FIG. 12 could be replaced by an anchor bar of circular cross-section. If the recess in the top end of each anchoring element is suitably shaped, then it may not be necessary to have a cooperating recess in the lower surface of the base. One such example is the use of a rectangular recess, which leads to a construction similar to the construction shown in FIGS. 1 to 3 but with the anchoring element joined to the rear surface of the facing element over the whole height thereof and the recess being formed in the body of the anchoring element. Obviously, the attachment methods similar to those described with reference to any of FIGS. 4 to 8 may suitably be used with this construction.

FIGS. 13 and 14 show facing units according to the invention that have a hexagonal front or facing element 61. A base 62 extends rearwardly from the rear surface of the facing element at the lower part thereof across substantially the whole width of that lower part. Two anchoring elements 63, 64 extend upwardly from the base and have lower sections 65, 66 joined to the rear surface of the facing element and upper sections 57, 68 spaced therefrom to form retaining surfaces. The units may be assembled and tied in to a reinforced earth structure according to any of the methods described above.

FIGS. 15 and 16 show facing units similar to those of FIGS. 1 to 3. In these units, however, the facing element has a rear part 71 and a front part 72, the two parts being offset both vertically and horizontally so that the front part of one unit will overlap the rear part of adjacent elements to improve interlocking and possibly improve water drainage pathways in a completed wall.

The units described have been shown with two symmetrically spaced anchoring elements extending upwardly from the base. However, it is possible to use one, three or more anchoring elements, and it is not necessary for anchoring elements to be symmetrically spaced. Obviously, considerable variation is permitted in the actual shape and size of the unit and of its component parts.

In certain locations it may be desirable for the wall of facing units to slope somewhat rearwardly from the vertical. Facing units for use in these circumstances may conveniently be of the general form shown in FIGS. 1 to 3 but with the facing surface and rear surface 3 of the facing element 1 inclined rearwardly so that the latter surface converges towards the front faces 12, 13 of the anchoring elements. In use, the faces 12, 13 will be disposed vertically to ensure secure anchorage for the reinforcing straps or other members.

It is not necessary that every facing unit of a reinforced earth structure be connected to an anchoring element. For example, in a multi-course construction it may suffice it the facing units of alternate course only are connected to anchoring elements, units of intermediate courses being held by the interlocking between courses. Other possible arrangements will be apparent.

I claim:

1. A reinforced earth structure comprising a plurality of integral facing units; each said facing unit comprising a facing element having a front surface and a rear surface, a base extending rearwardly from said rear surface at a lower part thereof across substantially the full width of said lower part, and at least one anchoring element of lesser width than the base extending upwardly from the base and having a retaining surface spaced rearwardly from and facing towards said rear surface to form behind said rear surface a space extending downwardly from the upper most part of said facing unit; said facing units being arranged so that said facing elements thereof extend substantially vertically and combine to form a wall; and anchoring members secured to anchoring elements of selected facing units and extending rearwardly therefrom into compacted earth behind said units, each anchoring member having a part thereof lying within said space and capable of moving downwardly therein in response to compaction and settlement of said earth.

2. A reinforced earth structure according to claim 1 in which each said anchoring element has a lower section joined to the rear surface of the respective facing element and an upper section spaced from said rear surface and presenting the retaining surface facing towards and parallel to the rear surface, said space being formed above said lower section.

3. A reinforced earth structure according to claim 1 in which each facing unit has two anchoring elements extending upwardly from the base, each anchoring element having a spaced defined between it and said rear surface, and said anchoring elements are arranged symmetrically to either side of a centre plane of the respective facing unit.

4. A reinforced earth structure according to claim 1 in which the uppermost part of each of said anchoring elements is substantially level with the uppermost part of the respective facing unit.

5. A reinforced earth structure according to claim 1 in which the uppermost part of each said anchoring element on each said unit is formed with interlock means engageable with a cooperating interlock means on the lower surface of a further facing unit supported above the first said unit.

6. A reinforced earth structure according to claim 1 in which each anchoring member is secured directly to said anchoring element of at least one of the units.

7. A reinforced earth structure according to claim 1 in which each anchoring member includes a link by way of which it is secured to said anchoring element of at least one of said units.

8. A reinforced earth structure according to claim 1 in which the lower part of each space is filled by resiliently compressible material bonded to the respective anchoring element.

* * * * *